United States Patent [19]

Spivey

[11] Patent Number: 4,635,723

[45] Date of Patent: Jan. 13, 1987

[54] CONTINUOUS INJECTION OF CORROSION-INHIBITING LIQUIDS

[76] Inventor: Melvin F. Spivey, 304 E. Horner, Atmore, Ala. 36502

[21] Appl. No.: 511,625

[22] Filed: Jul. 7, 1983

[51] Int. Cl.[4] ..... E21B 41/02; E21B 43/12; E21B 47/06

[52] U.S. Cl. ..... 166/250; 166/53; 166/64; 166/79; 166/91; 166/310; 166/371; 166/902

[58] Field of Search ..... 166/53, 64, 65.1, 66, 166/75.1, 79, 91, 244.1, 250, 279, 310, 312, 371; 137/88, 344, 391, 567

[56] References Cited

U.S. PATENT DOCUMENTS

| | | | |
|---|---|---|---|
| 2,884,067 | 4/1959 | Marken | 166/75.1 |
| 3,193,014 | 7/1965 | Hill | 166/64 X |
| 3,228,472 | 1/1966 | Rhoads, Jr. | 166/75.1 |
| 3,298,438 | 1/1967 | Anthony et al. | 166/75.1 X |
| 3,343,598 | 9/1967 | Meldau et al. | 166/251 |
| 3,463,178 | 8/1969 | Kirchmier | 137/391 X |
| 3,599,668 | 8/1971 | Ricardi | 137/567 X |
| 3,692,106 | 9/1972 | Basham et al. | 166/53 |
| 3,809,116 | 5/1974 | Sanner | 137/391 |
| 3,863,714 | 2/1975 | Watson, Jr. | 166/53 |
| 3,902,558 | 9/1975 | Watson, Jr. | 166/75.1 X |
| 4,059,149 | 11/1977 | Harrison | 166/64 |
| 4,064,936 | 12/1977 | McClure | 166/75.1 |
| 4,077,428 | 3/1978 | Weaver | 137/567 |
| 4,126,181 | 11/1978 | Black | 166/53 X |
| 4,267,148 | 5/1981 | Dickson et al. | 422/53 |
| 4,326,585 | 4/1982 | McStravick | 166/244.1 |
| 4,338,959 | 7/1982 | Krueger et al. | 137/93 |
| 4,354,553 | 10/1982 | Hensley | 166/64 X |
| 4,375,833 | 3/1983 | Meadows | 166/64 |
| 4,436,148 | 3/1984 | Maxwell | 166/64 X |

*Primary Examiner*—George A. Suchfield
*Attorney, Agent, or Firm*—Nixon & Vanderhye

[57] ABSTRACT

Corrosion inhibiting of well production tubing, such as for an oil or gas well, is provided in a simple and effective manner without interrupting well production. A portable skid has a chemical tank, water tank, pumps, conduits, and controls mounted on it, and is transported to the production well site. A mix of corrosion-inhibiting chemical and water is supplied from the tanks to an end conduit, and the end conduit is connected to an injection string, or an annulus associated with a side mandrel, of the production well. A computer control is provided for controlling the pumps, and other components, so that any desired amounts and proportions of a mix of chemical and water is continuously injected into the well to inhibit corrosion of the well production tubing string without interruption of production.

19 Claims, 4 Drawing Figures

FIG. 1
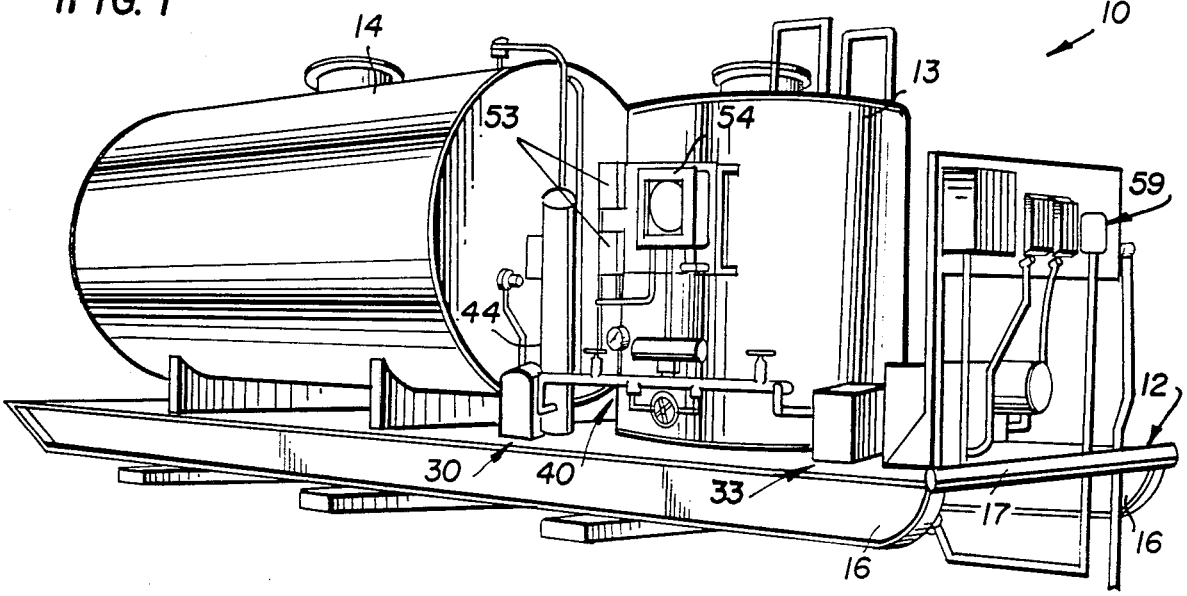
FIG. 2
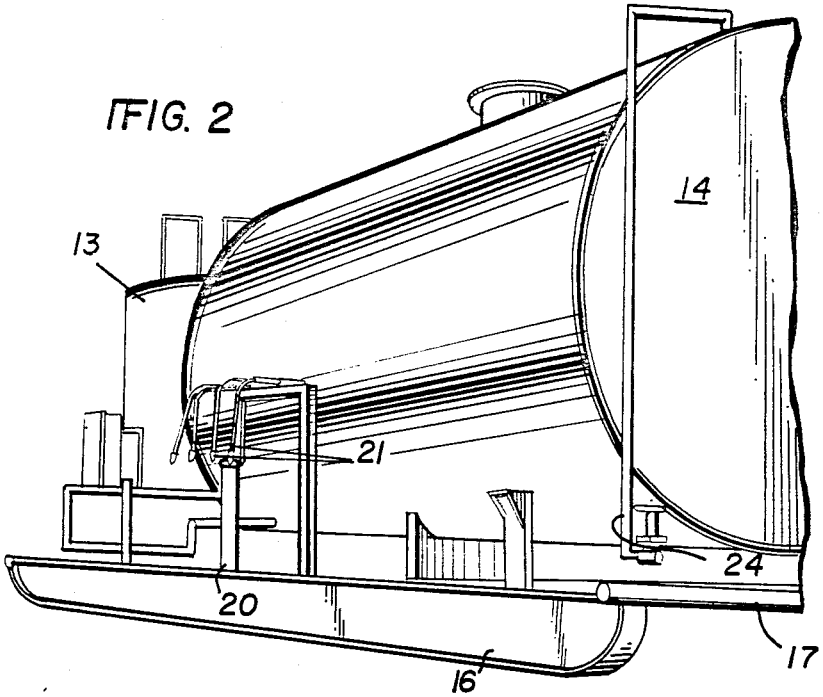
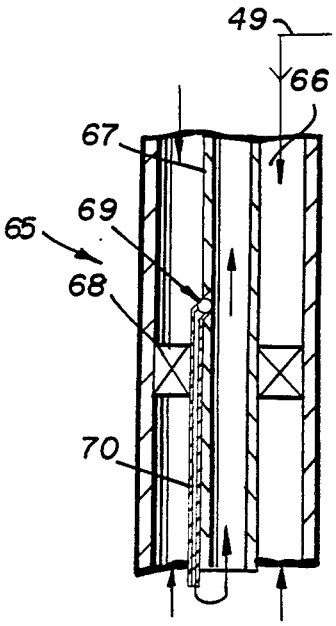
FIG. 3b

CONTINUOUS INJECTION OF CORROSION-INHIBITING LIQUIDS

BACKGROUND AND SUMMARY OF THE INVENTION

In conventional oil and gas well facilities, inhibiting corrosion of the production tubing is necessary in order maximize production and economic return. In present typical commercial situations, approximately twice each month the well is shut down and a corrosion inhibiting chemical is forced down the well under pressure. Such a procedure has been far less than desirable since the loss production time is extremely expensive, though periodic shut-down and corrosion operations are themselves costly and labor-intensive, and the corrosion-inhibiting treatment provided thereby is much less effective than desirable. Usually within several days after a treatment the corrosive effects of gases and liquids from the well reappear. Such corrosion, if improperly dealt with, can cause collapse of the tubing and total loss of the well.

Some of the problems associated with conventional procedures have been addressed by central batch-treating plants, which provide continuous treatment of the production tubing with inhibiting chemical. Typically a stationary, extensive, and expensive plant is built at a location central to a plurality of wells. Conduits are then led from the central plant to each of the wells, and corrosion-inhibiting chemical is continuously injected into the annulus (when a side pocket mandrel is utilized), or down one tubing string of a dual-string well.

According to the present invention, a system and procedure are provided which overcome most of the drawbacks associated with prior systems and procedures. According to the present invention, a production well can be continuously injected with corrosion inhibiting chemical so that collapse of the well will not occur, and there will not be lost production time due to well shut-down for corrosion-inhibiting treatments. The continuous injection according to the invention may be accomplished in a simple and inexpensive manner, and the system according to the invention is feasible for use with each individual production well. According to the present invention the content of corrosion inhibiting chemical is precisely and safely controlled so as to deliver a desired predetermined amount of corrosion inhibiting chemical to the well under all environmental conditions, and in a manner minimizing the risk of explosion, well damage, or operator injury.

According to one aspect of the present invention, a chemical tank, water tank, and delivery and control means are mounted on a portable skid. All of the components when so mounted can be transported on a flat-bed truck/trailer within standard highway weight, length, width, and height limits. The skid, and components thereon, can be easily handled by a small crane, and may be readily moved from one cite to another should that be desired for any reason. All components are conveniently accessible and operation is essentially automatic, and the system according to the invention is relatively inexpensive to construct.

While the system according to the invention is relatively inexpensive and highly portable, it precisely, and automatically, delivers a desired amount of corrosion-inhibiting chemical to the production well. The corrosion inhibiting chemical is injected at the bottom of the well and passes upwardly the entire length of the production tubing. Delivery of the appropriate amount of chemical is accomplished in a safe and efficient manner.

It is the primary object of the present invention to effectively inhibit corrosion of well production tubing in a simple and inexpensive manner. This and other objects of the invention will become clear from an inspection of the detailed description of the invention, and from the appended claims.

BRIEF DESCRIPTION OF THE DRAWINGS

FIG. 1 is a perspective view of an exemplary system according to the present invention;

FIG. 2 is a perspective view of the system of FIG. 1, taken at the opposite side thereof;

FIG. 3*b* is a detail schematic view illustrating another manner in which the system of FIG. 3*a* can be operatively interconnected to a production well.

DETAILED DESCRIPTION OF THE DRAWINGS

Figure 3A:
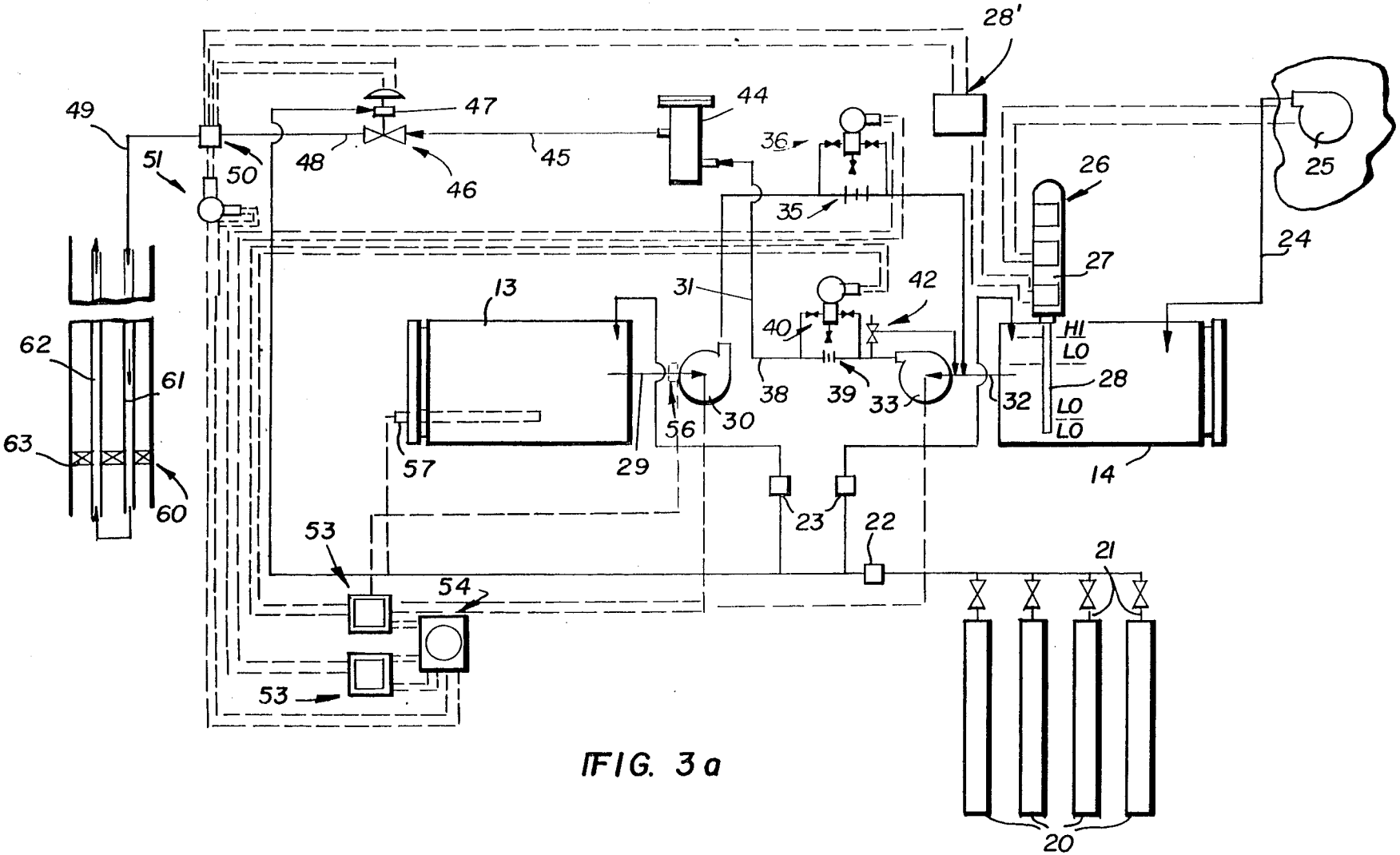
FIG. 3*a* is a fluid and electrical schematic illustrating all of the components of the system of FIGS. 1 and 2 and in conjunction with the schematic representation of a production well.

An exemplary portable system according to the present invention is shown generally by reference number 10 in FIG. 1. The system includes, as major structural components thereof, a skid 12, chemical tank 13, and water tank 14. The skid 12 includes a pair of spaced supports 16 and a platform 17. The supports 16 preferably comprise metal I-beams or the like, and the platform 17 a metal plate. The skid 12, tanks 13 and 14, and other components of the system 10 are dimensioned so that the entire system 10 may fit on a flat-bed truck/trailer, and will be within standard highway weight, length, width, and height limits.

The tank 13 may contain any desired corrosion-inhibiting chemical. A wide variety of such chemicals are commercially available, including various forms of $KP_2O_3$. In order to effectively deliver the correct amount of chemical, it is mixed with water from the tank 14 before delivery to the well.

Also mounted on the skid 12 are gas bottles 20 (see FIGS. 2 and 3*a*). The gas bottles supply gas to the tanks 13, 14, to pressurize the tanks, activate safety components, and the like. Any gas can be utilized which can perform the intended function without an unacceptable risk of explosion, nitrogen being the preferred gas. The bottles 20 are connected up to conduits 21 (see FIGS. 2 and 3*a*), which are in turn operatively connected to the tanks 13, 14 and other desired components.

As seen in FIG. 3*a*, gas delivered through conduits 21 passes through a pressure regulator 22. The regulator typically reduces the pressure of the nitrogen gas from about 2300 pounds per square inch to 60 pounds per square inch. Any gas passing to the tanks 13, 14 to pressurize the same would pass through further pressure regulators 23, which typically would reduce the pressure to 4 ounces per square inch.

Once the system 10 has been delivered to the well site, preferably the water tank 14 is operatively connected to a ground water source. Conduit 24 extending from tank 14 (see FIGS. 2 and 3*a*) is operatively connected to a water supply pump 25 mounted on skid 12, which in turn is connected to a water well on-site.

A level control 26 is provided for operating the pump 25 to maintain a sufficient level of water in the tank 14.

The level control 26 includes a body portion 27 and a probe portion 28. Preferably the level control is a tri-point capacitance type electronic level control, with a capacitance probe 28. As illustrated schematically FIG. 3a, there would be three positions sensed, a high position, a low position, and a low-low position. At the high position the control 26 would automatically shut the pump 25 off. At the low position, the pump 25 would be actuated to supply water to the tank 14. Should—for whatever reason—the water level in the tank ever reach the low-low position, the electronic level control 26 would automatically shut off the entire system, through an emergency cut-off controller 28'.

Chemical is delivered from the chemical tank 13 through first conduit 29 under the influence of position displacement pump 30, and is delivered by pump 30 through second conduit 31 to the third conduit 32 extending from water tank 14. Position displacement pump 33 withdraws water from the tank 14. The pumps 30, 33 are controlled to deliver any desired amounts and proportions of chemical and water for injection into the well.

A typical water pump 33 that could be utilized is a Milroyal pump model MR1-97-140, having a rated flow of 308 gallons per hours at 455 psi. A typical chemical pump 30 that could be utilized is a Milroyal pump model FR111A-73, a simplex disc diaphragm type pump. Both pumps are explosion proof, having effectively enclosed motors and electrical lead wires.

An orifice 35, or like means for controlling and metering flow (e.g. Venturi), is provided in the conduit 31 from pump 30 to conduit 32. A differential pressure transmitter 36 is operatively connected across the orifice 35, to cooperate with the orifice to effectively and accurately measure differential pressure, low gauge pressure, fluid flow rate, etc. An exemplary transmitter that may be utilized is a Barton model 6001 differential pressure transmitter, utilizing a capacitance-type transducer and producing an output signal that is compatible with a wide range of electronic receiving, control, and read-out devices.

In fourth conduit 38 connected to the discharge of water pump 33, an orifice 39, or like fluid flow control or metering device, is provided, and a differential pressure transmitter 40 operatively connected across the orifice 39. The transmitter 40 is preferably identical to the transmitter 36. Also operatively connected to the water pump discharge line 38 is the recirculating line 41 with emergency valve 42, which valve may be automatically opened in emergency situations to allow the water-chemical mix pumped by pump 33 to be continuously recirculated.

Connected to the conduit 38 is a filter 44. The filter may be of any suitable type, such a Peco model 55-4-336. The exit conduit 45 from filter 44 leads to a safety valve 46 operated by a pneumatic controller 47, and the discharge conduit 48 from the safety valve 46 ultimately leads to an injection conduit 49 for injection of the corrosion-inhibiting chemical mix into a production well.

The valve 46 may be of any suitable type, such as a conventional 2-position globe valve, having a pressure vane actuator 47. A solenoid operates the vane 47 to move it between its two positions, that in turn supplying actuating gas (e.g. nitrogen gas from bottles 20) to the actuator 47 to effect a desired movement of the globe component of the valve 46. For safety purposes, a separate canister of actuating gas is preferably located right at the valve 46 and connected to the controller 47, and adapted to supply gas to the controller 47 should there ever be insufficient pressure of gas supplied from the canisters 20.

A sensor 50 is disposed in the line 45, and is operatively connected to the differential pressure transmitter 51, the solenoid actuator for the valve 46, and the emergency cut-off device 28'. The transmitter 51 may be comparable to the transmitters 36, 40. Should the sensing means 50 ever sense a condition whereby—for whatever reason—well fluid was backing up through end conduit 49, the valve 46 would be closed, and the entire system would automatically be shut-down.

In order to provide precise control and monitoring of all of the components of the system 10, a computer and recorder are also provided. For example, a pair of standard flow computing systems 53 may be provided, such as a Dieterich Standard Flow Computing System. This System has a microprocessor base design that can be programmed to handle numerous control options and functions, and includes a DART that will interface with a wide variety of differential pressure transmitters, and is provided in a weather-proof container that may be wall or post mounted. Operatively connected to the computers 53 is a recorder 54, such as Bristol Round Chart Recorder series 4330-00C. Typically a three-pen recorder, recording water, chemical, and pressure input signals, would be provided. A number of additional sensors and controls may also be provided with the system 10. For instance were the chemicals to be utilized have viscosities that vary widely and dependence upon temperature, a temperature sensor—shown schematically in dotted line by component 56 in FIG. 3a—may be provided in line 29. The sensor 56 is operatively connected to computer 53, which in turn controls a conventional electric resistance heating element 57 provided in chemical tank 13, which is activated to heat the chemical in the tank 13 so that it achieves a temperature at which it has a desired viscosity.

An electrical control panel 59 (see FIG. 1) is mounted, preferably adjacent one end of the skid 12, in association with the system in order to provide for ready interconnection with an outside power source. Power lines from a portable generator at the well site, or from a municipal power supply, are fed to the control panel 59, and from the panel 59 are fed to all of the electrical components of the system 10, such as pumps 30, 33, heater 57, etc. Of course circuit breakers, or like protective devices, may be provided in the control panel if desired.

It will thus be seen that according to the present invention by appropriate programming of the computers 53, all of the components can be controlled so as to insure delivery of the precise amount of chemical-water mix to the injection conduit 49, in an automatic fashion.

Actual injection of the corrosion-inhibiting chemical into the well may be accomplished in a number of conventional manners. For instance as illustrated in FIG. 3a, the well 60 may have a dual string, an injection string 61 and a production string 62, mounted at the bottom of the well to the bore hole by packing 63 or the like. Such a system is conventionally used for a wide variety of well depths. The corrosion-inhibiting chemical would be injected from conduit 49 into tube 61, would flow out of the bottom of tube 61 and flow upwardly with the oil, gas, or other fluid being recovered, and would flow upwardly in production pipe 62. The chemical would stay in its liquid state, and would flow upwardly the entire length of the tubing 62, coating the entire interior surface thereof, and the exterior surface thereof below the packing 63. The amount of chemical delivered to the injection tube 61 would be controlled so that only a very small amount of chemical actually exited the top of the production tube 62 with the oil, gas, or other fluid being produced by the well. The small amount of chemical passing upwardly with the oil, gas, or the like could readily be removed by conventional means.

Another conventional well arrangement to which the injection conduit 49 could be connected is illustrated in FIG. 3*b*. The well 65 is a conventional well having a side pocket mandrel, an annulus 66 being provided surrounding the production tube 67, with a packing 68 adjacent the bottom of the tubing 67. The corrosion-inhibiting chemical is continuously injected into the annulus 66, and flows through conventional valving means 69 and small tube 70, to be discharged below the bottom of the tubing 67 and to flow upwardly with the oil, gas, or other fluids being produced by the well in the same manner as described with respect to the dual-string well of FIG. 3*a*.

It will thus be seen that according to the present invention there is provided a method for delivering a mix of corrosion-inhibiting chemical and water to a production well utilizing a portable skid having a chemical tank and water tank mounted thereon. The method comprises the following steps: Transporting the skid 12 to a single production well site. Operatively interconnecting the chemical and water tanks 13, 14 to an injection tube 61 or an annulus 66 associated with a side mandrel of the production well. Controlling delivery of a mix of corrosion-inhibiting chemical and water from the tanks to the production well so that any desired amounts and proportions of a mix of chemical and water are continuously injected into said well to provide corrosion-inhibiting of a production tube string 62, 67 of the well without interruption of production through the production tube string. Also, the production well site preferably includes a water well, and the method comprises the further step of operatively interconnecting the water tank 14 and the water well to supply water—thru line 24—to the water tank from the water well as needed.

It will also be seen that according to the present invention a portable, inexpensive, and effective system and method have been provided for delivering corrosion-inhibiting chemicals to a production well. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent systems and procedures.

What is claimed is:

1. A portable system for the continuous injection of corrosion-inhibiting chemical into a production well, comprising: a portable skid; a corrosion-inhibiting chemical tank, and a water tank, mounted on said skid; pump means for pumping any desired amounts and proportions of chemical and water from said tanks for injection into a production well, said pump means mounted on said skid; conduit means operatively interconnecting said pumps and tanks for delivery of corrosion-inhibiting chemical to a production well, said conduit means including an end conduit for operative interconnection to a production well; and control means, mounted on said skid for controlling the operation of said pump means to provide desired amounts and proportions of a mix of corrosion-inhibiting chemical and water to said end conduit.

2. A system as recited in claim 1 wherein said skid, tanks, pump means, and all other components mounted on said skid, are dimensioned so that said entire system fits on a flat-bed truck/trailer, and is within standard highway weight, length, width, and height limits.

3. A system as recited in claim 1 wherein said control means comprise computer control means.

4. A system as recited in claim 1 further comprising gas conduit means for interconnection with a plurality of compressed gas cannisters mounted on said skid for supplying gas under pressure to the tops of said chemical and water tanks.

5. A system as recited in claim 4 further comprising pressure regulator means disposed in operative association with said gas conduits means for regulating the pressure of gas supplied from said cannisters to said tanks.

6. A system as recited in claim 1 wherein said pump means comprises a positive displacement chemical pump, and a separate positive displacement water pump; and wherein said conduit means comprises a first conduit interconnecting said chemical tank and said chemical pump; a second conduit operatively connected between the discharge from said chemical pump and the inlet to said water pump; a third conduit interconnecting said water tank and said water pump; and a fourth conduit operatively interconnecting the discharge from said water pump and said end conduit.

7. A system as recited in claim 6 further comprising means for controlling and metering flow operatively disposed in each of said second and fourth conduits; and a differential pressure transmitter means operatively associated with said means for controlling and metering flow in each of said second and fourth lines, said differential pressure transmitter means operatively connected to said control means.

8. A system as recited in claim 7 further comprising a recirculating line for operatively interconnecting said fourth conduit and said third conduit, and a valve disposed in said recirculating line.

9. A system as recited in claim 8 further comprising safety valve means disposed in said end conduit, and means for automatically actuating said safety valve means in response to sensing of one or more undesired conditions.

10. A system as recited in claim 9 wherein said safety valve means includes an actuator means, said actuator means comprising a solenoid actuator for actuating a pneumatic controller operatively connected to a pressurized source of non-explosive gas, and wherein said solenoid is activated in response to a sensing means for sensing backup of well fluid into said end conduit.

11. A system as recited in claim 1 further comprising safety valve means disposed in said end conduit, and means for automatically actuating said safety valve means in response to sensing of one or more undesired conditions.

12. A system as recited in claim 11 wherein said safety valve means includes an actuator means, said actuator means comprising a solenoid actuator for actuating a pneumatic controller operatively connected to a pressurized source of non-explosure gas, and wherein said solenoid is activated in response to a sensing means for sensing backup of well fluid into said end conduit.

13. A system as recited in claim 1 further comprising a level control means operatively associated with said water tank; an emergency cut-off means mounted on said skid; a water supply pump mounted on said skid and operatively interconnected to a water well on the production well site; and means for operatively interconnecting said level control means and said emergency cut-off means and said water supply pump.

14. A system as recited in claim 1 further comprising a differential pressure transmitter operatively associated with said end conduit and operatively connected to said control means.

15. A system as recited in claim 1 wherein said end conduit is operatively connected to an injection string, or an annulus connected to a side pocket mandrel, of a production well.

16. A method for delivering a mix of corrosion-inhibiting chemical and water to a production well utilizing a portable skid having a chemical tank and water tank mounted thereon, comprising the steps of:

transporting the skid to a single production well site;

operatively interconnecting the chemical and water tanks to an injection tube string, or an annulus associated with a side mandrel, of the production well; and controlling delivery of a mix of corrosion-inhibiting chemical and water from the tanks to the production well so that any desired amounts and proportions of a mix of chemical and water are continuously injected into the well to provide corrosion-inhibiting of a production tube string of said well without interruption of production through said production tube string.

17. A method as recited in claim 16 wherein the production well site includes a water well distinct from the production well, and comprising the further step of operatively interconnecting the water tank and the water well to supply water to the water tank from the water well as needed.

18. A system comprising:

a production well at a production well site, said well including a production tube string and either an injection tube string, or an annulus connected to a side mandrel, or the like;

a chemical tank, a water tank, a chemical pump, a water pump, and conduits interconnecting said tanks and pumps, disposed on said production well site; said conduit means comprising a first conduit interconnecting said tanks and pumps, disposed on said production well site; said conduit means comprising a first conduit interconnecting said corrosion-inhibiting chemical tank and said chemical pump, a second conduit interconnecting the discharge of said chemical pump and the inlet of said water pump; a third conduit interconnecting said water pump and said water tank, and a fourth conduit extending from the discharge of said water pump, said chemical and water pumps;

an end conduit interconnecting said fourth conduit and said injection tube string or annulus of said production well;

control means for automatically controlling said pumps to continuously deliver from said chemical and water tanks any desired amounts and proportions of a mix of corrosion-inhibiting chemical and water to said end conduit for continuous injection into said production well;

means for controlling and metering flow operatively disposed in the each of said second and fourth conduits;

a differential pressure transmitter means operatively associated with said means for controlling and metering flow in each of said second and fourth conduits, said differential pressure transmitter means operatively connected to said control means; and safety valve means disposed in said end conduit, and means for automatically actuating said safety valve means in response to sensing of one or more undesired conditions.

19. A system as recited in claim 18 further comprising a recirculating line for operatively interconnecting said fourth conduit and said third conduit, and a valve disposed in said recirculating line.

* * * * *